US007494077B2

(12) United States Patent
Chen

(10) Patent No.: US 7,494,077 B2
(45) Date of Patent: Feb. 24, 2009

(54) TWO-WAY SELF-LOCK PAPER SHREDDER

(75) Inventor: Kent Chen, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 259 days.

(21) Appl. No.: 11/607,540

(22) Filed: Dec. 1, 2006

(65) Prior Publication Data

US 2007/0125892 A1 Jun. 7, 2007

(30) Foreign Application Priority Data

Dec. 2, 2005 (CN) ..... 2005 2 0047181

(51) Int. Cl.
*B02C 25/00* (2006.01)

(52) U.S. Cl. ..... 241/36; 241/100; 241/101.3; 241/236

(58) Field of Classification Search ..... 241/36, 241/101.3, 236, 100

See application file for complete search history.

(56) References Cited

U.S. PATENT DOCUMENTS 7,420,344 B2 * 9/2008 Zhong ..... 318/434

* cited by examiner

*Primary Examiner*—Mark Rosenbaum
(74) *Attorney, Agent, or Firm*—WolfBlock LLP

(57) ABSTRACT

A two-way self-lock paper shredder has a functional switch (11), a shredding mechanism (10), a control circuit power source (2) electrically connected to the said functional switch (11), as well as the following control circuits: a CPU (1), a motor-driving circuit (8), a reverse detection circuit (9), a paper-in detection circuit (5), and an unlocking circuit (4). If there is neither an input of paper-in signal nor an input of reverse signal after the paper is shredded, the said paper-in detection circuit (5) will transfer a self-lock signal to said CPU (1) and then the CPU (1) begins timing. When the duration of said self-lock signal exceeds the preset value, the CPU (1) will shut off the motor-driving circuit (8) and the paper shredder will be self-locked. The aforesaid unlocking circuit (4) contains an unlocking key, and reset of the said unlocking key can unlock the paper shredder. The present utility model enhances the safety of the paper shredder efficiently, so as to avoid unnecessary hidden trouble.

7 Claims, 3 Drawing Sheets

TWO-WAY SELF-LOCK PAPER SHREDDER

This application claims benefit of prionty to Patent Application No. 200520047181.X filed Dec. 2, 2005 in the People's Republic of China.

BACKGROUND OF THE INVENTION

1. Field of the Utility Model

The present utility model relates to office equipment, and more particularly, to a paper shredder with lock function.

2. Description of the Related Art

Paper shredder is a kind of common office equipment used to shred documents so as to protect commercial confidentiality. At present, paper shredders have entered ordinary families. The paper shredder is generally in the automatic detection status before the power supply is shut off or before the electric power line is plugged out, so the paper shredder will automatically start to engulf and then shred the article when any article is detected out at the paper inlet. Thus, very dangerous hidden troubles will be caused. For example, if a child put his/her hands into the paper inlet incautiously, a very serious accident will happen.

Now a paper shredder with lock function is provided. Please refer to FIG. 1-2 and the circuit diagram for the shredding motor is indicated inside the dashed-line frame in FIG. 2. The functional switch K1 can be positioned in shredding status A, paper ejection status B, or shutdown status C via push-pull contact D. When functional switch K1 is positioned in shredding status A and safety switch K2 and on-switch K3 are closed, the paper shredder begins to shred paper; when functional switch K1 is positioned in shutdown status C, the paper shredder is idle even though the safety switch K2 and on-switch K3 are closed; when functional switch K1 is positioned in the paper ejection status B and the safety switch K2 is closed, the paper shredder begins to reverse and eject paper no matter whether the on-switch K3 is closed or not. Once the paper is shredded, please position the lock switch K4 in the lock status to lock the paper shredder, otherwise the lock function of the paper shredder is unused. When the paper shredder is in locking status, the lock switch K4 must be positioned in unlocking status if the machine is to be recovered to running status. To sum up, this paper shredder implements the lock function via a mechanical means (i.e. lock switch K4). If the user forgets to position the lock switch in locking status after the paper is shredded, the paper shredder will automatically start to engulf and then shred the article when any article is detected out at the paper inlet. In that case, the said hidden safety troubles have not been settled root and branch.

SUMMARY OF THE UTILITY MODEL

The object of the present utility model is to conquer the deficiency in technology and provide a safe and reliable two-way self-lock paper shredder that can automatically control the paper shredder to lock when it is in both shredding status and paper ejection status (that is, the shredding motor normally rotates and reverses) via an electronic control circuit.

In order to resolve said technical problems, the present utility model provides the following technical proposal: a two-way self-lock paper shredder consisting of a functional switch, a shredding mechanism, a control circuit power source electrically connected to the functional switch, and the following control circuits:

CPU;

Motor-driving circuit. One end is electrically connected with the CPU, and the other end is electrically connected with the shredding mechanism. It is used to drive the shredding machine to run;

Reverse detection circuit. One end is electrically connected with CPU and the other end is electrically connected with shredding machine. It is used to detect the reverse signal and transfer such a reverse signal to the CPU, so that the CPU will control the shredding machine to reverse;

Paper-in detection circuit. One end is electrically connected with CPU and the other end is electrically connected with control circuit power source. It is used to detect the paper-in signal. When the paper is put into the inlet of the shredding machine, the paper-in detection circuit will transfer the paper-in signal to the CPU for processing and then the motor-driving circuit is conducted and drives the shredding machine to run. If there is neither an input of paper-in signal nor an input of reverse signal after the paper is shredded, the said paper-in detection circuit will transfer the stand-by signal to the said CPU. When this CPU begins timing, if the duration of the said stand-by signal exceeds the preset value, the CPU will shut off the motor-driving circuit and the paper shredder will be in self-locking;

Unlocking circuit. One end is electrically connected with CPU and the other end is connected with control circuit power source. This unlocking circuit is equipped with an unlocking key K1. When the paper shredder is in self-locking, the unlocking circuit will transfer the unlocking signal to the CPU if the unlocking key is reset, so that the CPU will take control to close the motor-driving circuit and then the paper shredder will be unlocked.

Furthermore, the two-way self-lock paper shredder can also be equipped with an overload protection circuit, one end of which is connected with the shredding mechanism and the other end of which is connected with the CPU. The overload protection circuit will transfer the overload signal to the CPU if an excessive amount of paper is put in, so that the CPU will take control to shut off the motor-driving circuit.

In addition, the two-way self-lock paper shredder can be also equipped with a lock indication circuit to indicate whether the paper shredder is in self-lock status or not, one end of which is electrically connected to CPU and the other end of which is earthed. The lock indication circuit is equipped with lock indicators.

Moreover, the two-way self-lock paper shredder can be equipped with a lock status switching circuit as well, through which the user can select self-lock function. One end of the lock status switching circuit is connected to the CPU and the other end is connected to the positive pole of the control circuit power source when the paper shredder possesses self-lock function or is earthed when paper shredder does not possess self-lock function.

For the present utility model is equipped with an electronic control circuit that can automatically control the paper shredder to lock when it is in both shredding status and paper ejection status, the safety of the paper shredder is efficiently improved, so as to avoid unnecessary hidden trouble.

DETAILED DESCRIPTION OF THE UTILITY MODEL

Hereinafter, the preferred embodiments of the present utility model will be explained with reference to the drawings FIG. 3-FIG. 5:

The utility model is a kind of two-way self-lock paper shredder consisting of functional switch 11, shredding mechanism 10 and an electronic control circuit. The power source is connected with functional switch 11 after first connected to safety switch and fuse. Shredding mechanism 10 is the same as that of the traditional paper shredder, which is used to shred paper and driven by the motor to run the blades. The key point of the present utility model is the electronic control circuit.

Figure 1:
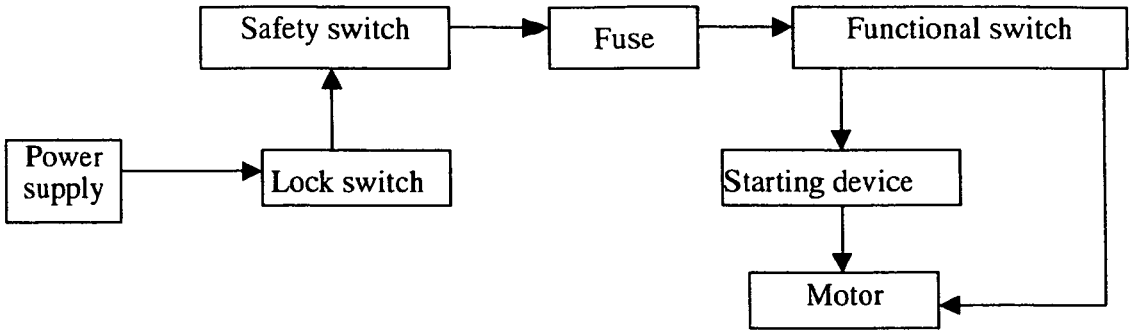
FIG. 1 is a block diagram for the operating principle of paper shredders based on the prior art.
Figure 2:
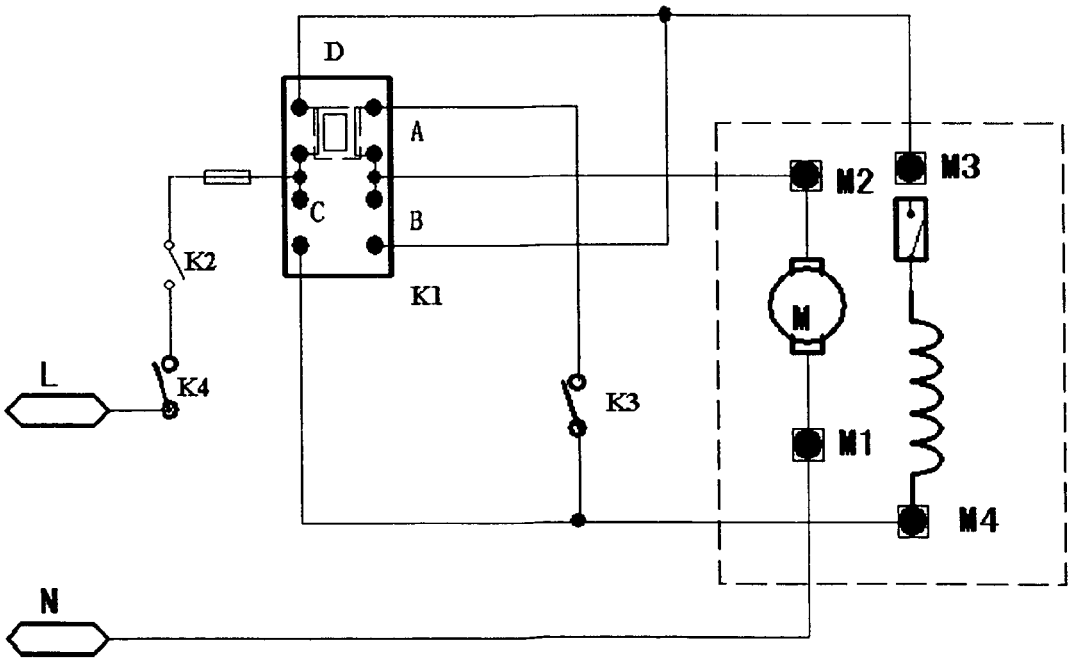
FIG. 2 is a circuit diagram of paper shredders based on the prior art.
Figure 3:
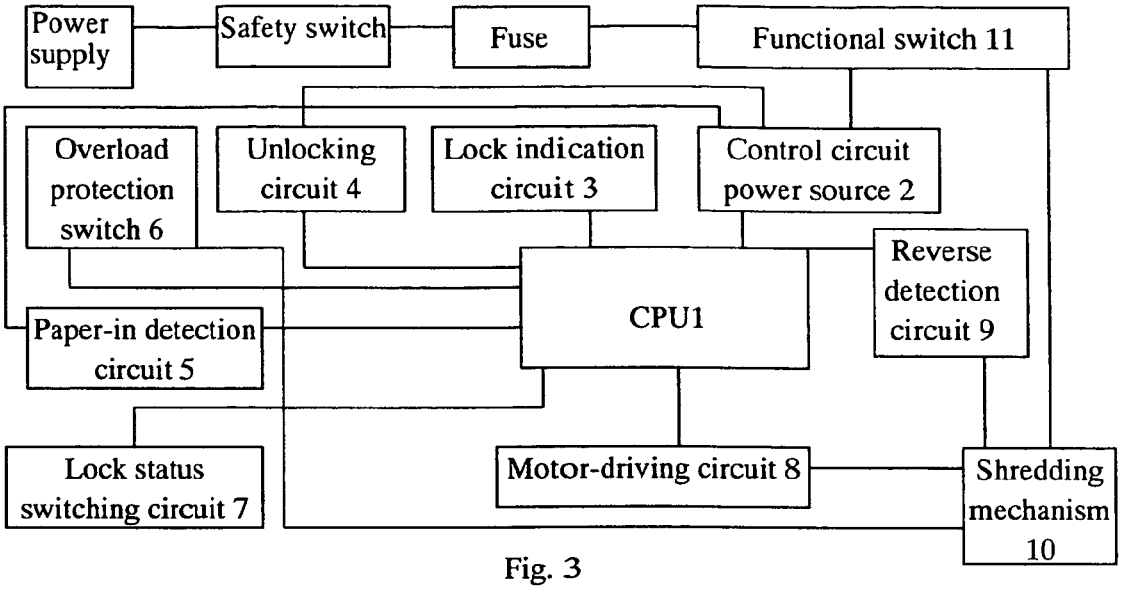
FIG. 3 is a block diagram for the operating principle of the two-way self-lock paper shredder based on the present utility model.

The structure of each sub-circuit of the control circuit and the electrical connection between sub-circuits are described as follows:

Referring to FIG. 3, CPU 1 is connected to control circuit power source 2, lock indication circuit 3, unlocking circuit 4, paper-in detection circuit 5, overload protection circuit 6, lock status switching circuit 7, motor-driving circuit 8, and reverse detection circuit 9 respectively.

Figure 4:
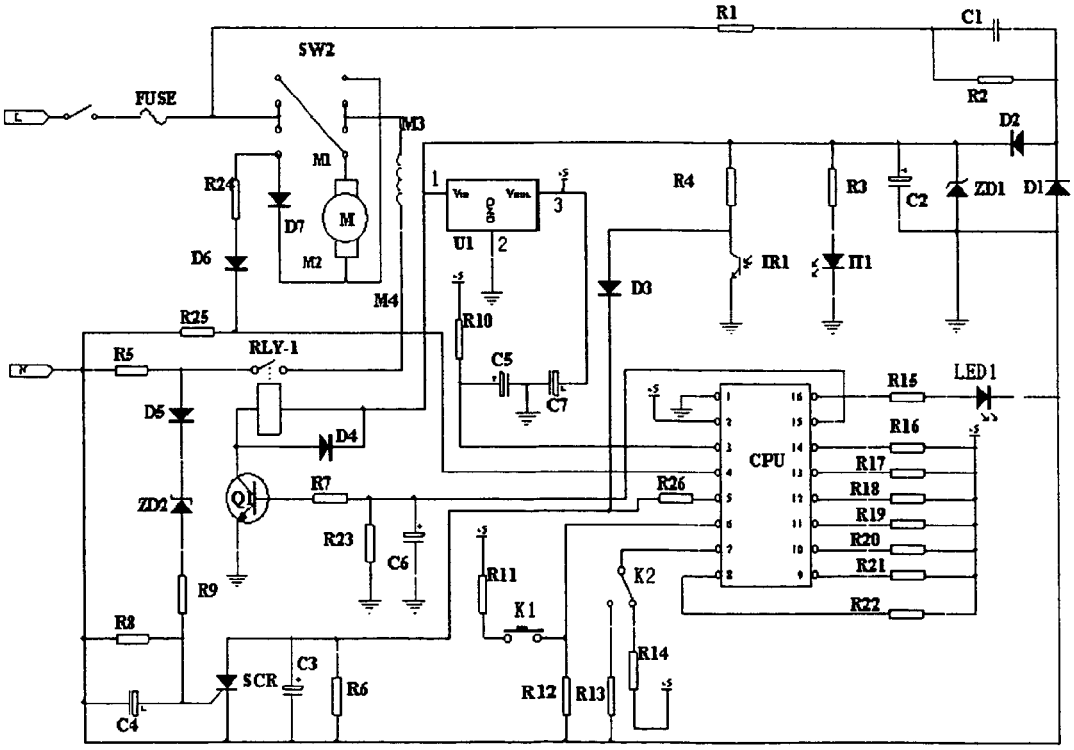
FIG. 4 is a circuit diagram of the two-way self-lock paper shredder based on the present utility model.

Referring to FIG. 4, CPU 1 is a single-chip HEADER 8×2, which is the key part of the circuit. Its pins are defined as follows:

Pin 1: earthed;

Pin 2: connected with +5V power supply;

Pin 3: reset;

Pin 4: function state (normally rotate, reverse);

Pin 5: paper-in signal, overload signal input, paper-in signal detection, effective for high levels;

Pin 6: unlocking function (high-level unlocking);

Pin 7: lock status switching (lock, unlock);

Pin 8-Pin 14: vacant;

Pin 15: motor drive control;

Pin 16: lock indication control. High level lock indicator is on.

For Pins 8 to 14 of this singlechip are vacant, they are respectively connected with +5V power supply via resistance R16-R22, which can limit the current.

Resistance R1, capacitor C1, resistance R2, optical diode D1 and D2, and voltage regulation diode ZD1 compose the capacitance-resistance and step-down (24V) circuit, which provides voltage for the power supply circuits of relay RLY-1 and CPU 1. The voltage regulation circuit composed of three-terminal voltage-regulation integrated circuit 78L05 and capacitor C7 supplies 5V DC voltage for CPU 1. The three-terminal voltage-regulation integrated circuit 78L05 inputs 24V DC at Pin 1 and outputs 5V DC at Pin 3. The output 5V DC is then filtered through capacitor C7, so as to make the voltage more stable. The capacitance-resistance and step-down circuit and voltage regulation circuit compose the control circuit power source 2. The reset circuit is composed of Pin 3 of CPU 1 and resistance R10 and capacitor C5 connected in parallel, which is used to play a role in charging and discharging. When the voltage at both ends of the capacitor C5 drops to a certain value, CPU 1 will stop running; contrarily, when the voltage at both ends of the capacitor C5 increases to a certain value, CPU 1 will begin to run.

Motor-driving circuit 8 consisting of triode Q1, current limiting resistance R7, divider resistance R23, capacitor C6, relay RLY-1 and optical diode D4 is used to drive shredding mechanism 10. Hereinto, one end of the switch of relay RLY-1 is connected with functional switch SW2 and the other end is connected with resistance R5; while, the loops of relay RLY-1 after first connected with optical diode D4 in parallel are connected to the collector of triode Q1, whose base electrode is connected with one end of the current limiting resistance R7 in series and whose emitting electrode is earthed. The other end of the current limiting resistance R7 is connected to the Pin 15 of CPU 1 via electrical connection. The said capacitor C6 plays a role in filtering and composes a discharge circuit together with divider resistance R23. When the Pin 15 of CPU 1 outputs high level, the triode Q1 is conducted and the switch of relay RLY-1 is closed and the shredding mechanism 10 is therefore started; when the Pin 15 of CPU 1 outputs low level, triode Q1 is cut off, the reverse voltage generating on the loops of relay RLY-1 is released through optical diode D4, the switch of relay RLY-1 is broken, and the shredding mechanism 10 is therefore stopped.

Resistance R24, optical diode D6 and resistance R25 compose the reverse detection circuit 9 and motor M, M1, M2, M3, and M4 make up the shredding mechanism 10. One end of resistance R24 is connected with shredding mechanism 10 through optical diode D7 and one end of resistance R25 is connected with Pin 4 of CPU 1. When the functional switch SW2 of the paper shredder is placed in the reverse position, the reverse signal, after limited by resistance R24, rectified by optical diode D6, and divided by resistance R25, is transferred to Pin 4 (voltage here is about 5V) of CPU 1 for being processed by CPU 1, then Pin 15 outputs high level, and thus the motor-driving circuit 8 runs to drive the motor of shredding mechanism 10 to reverse. When functional switch SW2 is placed in normal position, there is no current passing through resistance R24 and optical D6 for the optical diode D7 is unilaterally conducted. Therefore, there is no signal input into Pin 4 of CPU1 and the motor of shredding mechanism begins to normally rotate.

The paper-in detection circuit 5 consisting of infrared transmitting circuit and infrared receiving circuit connected with each other in series is used to detect whether any paper is put into the paper shredder. When any paper is put in, the paper-in detection circuit 5 generates paper-in signal and transfers such signal to CPU 1. Hereinto, the infrared transmitting circuit is composed of infrared transmitting tube IT1 and current limiting resistance R3 connected in series. The input terminal of resistance R3 is connected with positive pole of capacitor C2 and the output terminal of the infrared transmitting tube IT1 is earthed; infrared receiving circuit is composed of infrared receiving tube IR1, current limiting resistance R4 and optical diode D3 connected together via electrical connection. The input terminal of resistance R4 is also connected with positive pole of capacitor C2, the output terminal of the infrared receiving tube IR1 is earthed, and the output terminal of optical diode D3 is connected with Pin 5 of CPU 1 via resistance R26. When the paper-in detection circuit 5 runs, the infrared transmitting tube IT1 will transmit infrared rays. If such infrared rays is received by the infrared receiving tube IR1, infrared receiving tube IR1 is conducted, the voltage at its both terminals is less than 1V, and optical diode D3 is cut off; when any paper is put into the inlet of paper shredder, infrared receiving tube IR1 is cut off for it cannot receive the infrared light from infrared transmitting tube IT1 due to the obstruction of the paper, the electric potential difference between its both terminals are beyond 5V, the optical diode D3 is conducted, and Pin 5 of CPU 1 therefore receives the paper-in signal.

Unlocking circuit 4 consisting of resistance R11 and R12 and unlocking key K1 is used to unlock the paper shredder in self-locking status. One end of the resistance R11 is connected with a +5V power supply, the other end is connected with one end of the unlocking key K1, while the other end of the unlocking key K1 is connected with Pin 6 of CPU 1 and resistance R12 respectively via electrical connection, and the other end of resistance R12 is earthed. In general, when the unlocking key K1 is broken, Pin 6 of CPU 1 is low level for resistance R12 is earthed; when paper shredder is self-locked and the unlocking K1 is then reset, CPU 1 automatically unlocks itself and takes the control the conduct motor-driving circuit 8, and the machine recovers to normal operation.

Detailed operating principle of the utility model is as follows:

Place the functional switch SW2 of paper shredder in the normal position (shredding status); If any paper is put into the inlet of paper shredder, the infrared receiving tube IR1 is cut off for it cannot receive the infrared rays from infrared transmitting tube IT1; the electric potential difference between its both terminals are beyond 5V; and then the optical diode D3 is conducted, the high level at Pin 5 of CPU1 is output after being processed by CPU 1, triode Q1 is conducted, switch of relay RLY-1 is closed, and at last the shredding mechanism 10 begins to run. C3 and R26 compose the paper-in time-delay circuit, which will keep the paper-in signal for 1-3 seconds after the paper is shredded so as to complete the clearing work. R6 can discharge C3 so as to make the paper-in signal to be decreased to "0" gradually.

If the functional switch SW2 of the paper shredder is placed in the reverse position, the reverse detection circuit 9 begins to work. The reverse signal, after limited by resistance R24, rectified by optical diode D6 and divided by resistance R25, is transferred to Pin 4 (voltage here is about 5V) of CPU 1 for being processed by CPU 1, then Pin 15 outputs high level, and thus the triode Q1 of motor-driving circuit 8 is conducted, switch of relay RLY-1 is closed, and at last the motor of shredding mechanism 10 begins to reverse.

If there is neither an input of paper-in signal nor an input of reverse signal after the paper is shredded and infrared receiving tube IR1 receives the infrared rays from infrared transmitting tube IT1, infrared receiving tube IR1 is conducted, electric potential difference between its both terminals is 0.1-0.3V, and the P pole of optical diode D3 is low level, and thus there is no output from Pin 5 of CPU1 and no reverse signal input into Pin 4. Pin 5 inputs self-lock signal to CPU1 and then CPU1 begins timing. If the stand-by time exceeds the preset value and there is no output from the CPU1, the motor-driving circuit 8 is shut off and the machine is self-locked. If the paper-in signal is received during the stand by period of paper shredding, Pin 5 outputs high level that is then be processed by CPU1, Pin 15 outputs high level, motor-driving circuit 8 runs, and paper shredder begins to normally rotate and shred paper. If the reverse signal is received, such reverse signal is transferred to Pin 4 for being processed by CPU 1, then Pin 15 outputs high level, motor-driving circuit 8 runs, and paper shredder begins to reverse.

When the paper shredder is in the status of self-lock control, if electrified, Pin 15 of CPU 1 outputs low level, triode Q1 is cut off, switch of relay RLY-1 is broken (that is, the motor-driving circuit 8 cannot be conducted), and meanwhile, Pin 16 of CPU 1 outputs a high level. At that time, the machine will not work no matter whether the functional switch SW2 of the paper shredder is placed in the normal position or reverse position. If the paper shredder is required to be recovered to work, the unlocking key K1 shall be reset. After unlocking key K1 is reset, the voltage is divided by R11 and R12 of unlocking circuit 4, the high level is input into Pin 6 of CPU1 and then output from Pin 15 after processed by CPU1, triode Q1 is conducted, switch of relay RLY-1 is closed, and motor-driving circuit 8 is conducted to drive the shredding mechanism 10 to recover to normal work.

Furthermore, the overload protection circuit 6 can be equipped. The overload protection circuit 6 is composed of resistance R5, optical diode D5, voltage regulation diode ZD2, resistance R8 and R9, capacitor C4 and silicon-controlled rectifier (SCR). One end of resistance R5 is connected to the motor via electrical connection, and the other end is first connected with optical diode D5, voltage regulation diode ZD2, and resistance R9 in series, then connected with parallel circuit composed of resistance R9 and capacitor C4, and at last connected with the trigger of SCR; while, the other end of SCR is connected with Pin 5 of CPU1 via resistance R26. In the process of shredding, if an excessive amount of paper is put in, the load of paper shredder increases and so does the actual power, and thus the current of machine and step-down on the resistance R5 will increase as well according to the basic formula of electrics; the higher voltage is rectified by resistance R9; when the voltage becomes sufficient, voltage regulation diode ZD2 is conducted and the voltage conducted enters the trigger of SCR after limited by resistance R9, divided by resistance R8 and filtered by capacitor C4; when the ignition current and voltage are sufficient, SCR is conducted and then the electric potential difference becomes 1.1V; in that case, the potential difference at Pin 5 of CPU 1 decreases, Pin 15 outputs low level, triode Q1 is cut off, and switch of relay RLY-1 is broken; at last, shredding mechanism stops. Further, the lock indication circuit 3 can also be equipped to judge whether the paper shredder is in self-locking. The lock indication circuit 3 consisting of lock indicator LED1 and its current limiting resistance R15 connected in series is used to indicate whether the paper shredder is in self-locking. One end of current limiting resistance R15 is connected to Pin 16 of CPU 1, the other end is connected with one end of lock indicator LED1, and the other end of LED1 is earthed. When paper shredder is in unlocking status, Pin 16 of CPU 1 outputs low level and lock indicator LED1 does not light up; contrarily, when paper shredder is in self-locking, lock indicator LED1 lights up. To select and use proper resistance R15 can prolong the lifespan of lock indicator LED1.

Furthermore, lock status switching circuit 7 can be equipped as well. This lock status switching circuit 7 is composed of resistance R13, resistance R14 and self-locking status key K2. With this circuit, the switch between self-locking function and unlocking function can be implemented. One end of self-locking status key K2 is connected to Pin 7 of CPU1 via electrical connection and the other end is connected with resistance R13 or resistance R14 via electrical connection, that is, the electrical connection between K2 and R13 or R14 can be selected by switching the self-locking status key K2. When self-locking status key K2 is connected with R14 via electrical connection and R14 is connected to a +5V power supply, the +5V voltage after limited by R14 is transferred to Pin 7 of CPU 1 through self-locking status key K2, then Pin 7 outputs high level, and self-locking function of paper shredder is started; when self-locking status key K2 is connected with R13 via electrical connection and R13 is earthed, Pin 7 of CPU 1 is earthed through R13, so Pin 7 inputs low level and self-locking function of paper shredder is shut down. When self-locking function of paper shredder is shut down, the machine can normally operate to shred paper or reverse to eject paper.

Figure 5:
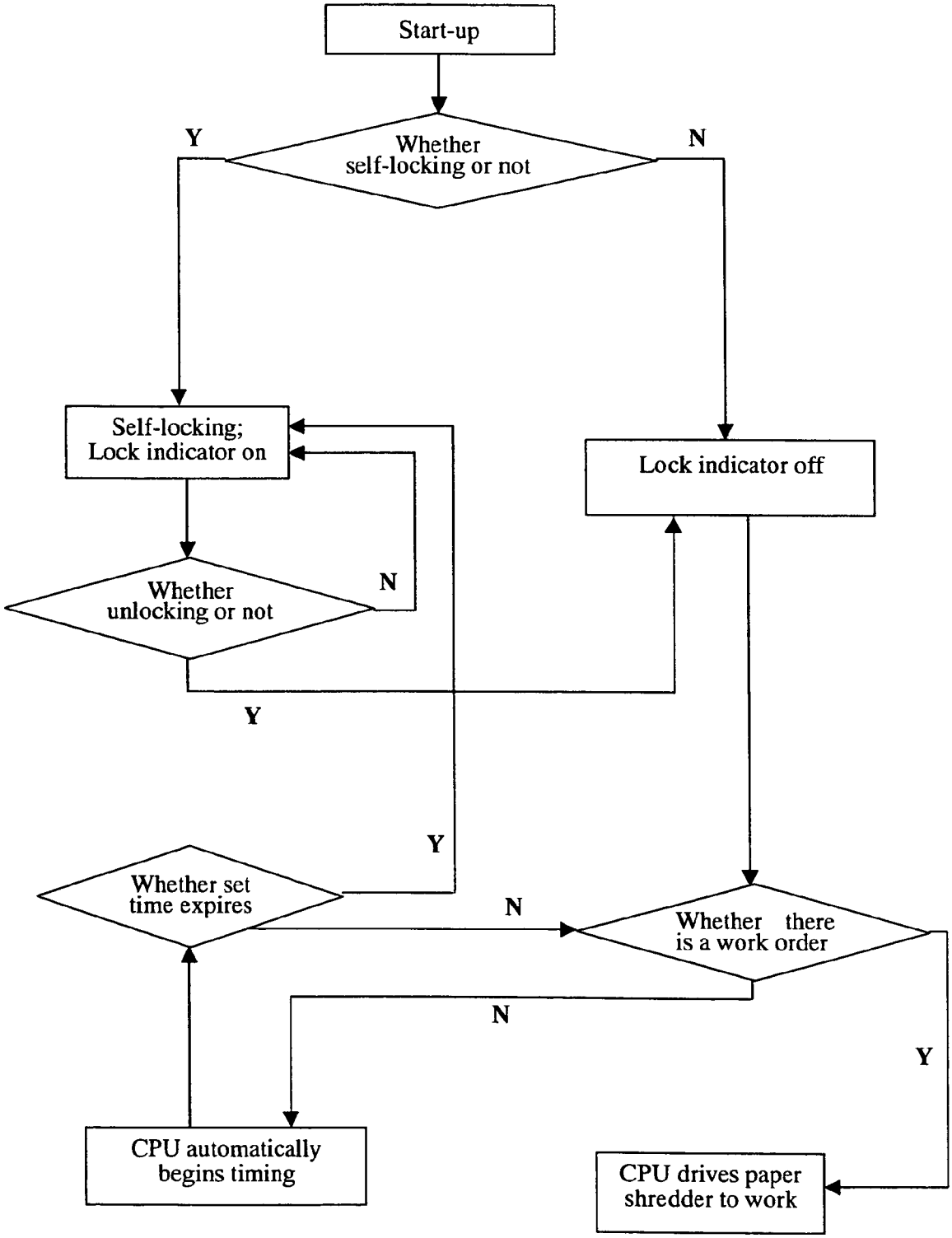
FIG. 5 is a flow chart for self-locking control of the two-way self-lock paper shredder based on the present utility model.

FIG. 5 is the flow chart for self-locking control of the utility model. Referring to FIG. 5, when machine is started, paper shredder first detects whether it is in self-locking. If in self-locking, lock indicator LED1 does not light up and detection of whether there is work order is performed. If work order is found, Pin 15 of CPU 1 outputs high level and motor-driving circuit 8 is conducted to drive the motor of shredding mechanism, which will at last drive the blades to work; if no work order is found, CUP 1 automatically begins timing. If the time is accumulated to reach the preset self-locking time, the paper shredder will be self-locked and lock indicator LED1 lights on; if not reach the preset self-locking time, the paper shredder will check whether there is any work order again. If the detection indicates that the paper shredder is already in self-locking after started and lock indicator lights on, the machine will not work even though there is work order, but wait for the unlocking signal. If the unlocking signal is detected, lock indicator LED1 is off and detection of whether there is work order is performed; if no unlocking signal is detected, the machine will be kept self-locked.

The abovementioned preferred embodiment does not limit the protection scope of the present utility model. The essence of the utility model is to implement the two-way (shredding and ejection) self-lock for paper shredder by setting the electronic control circuit, so as to improve the safety when using paper shredder and prevent the user from being damaged due to misoperation.

What is claimed is:

1. A two-way self-lock paper shredder having a functional switch (11), a shredding mechanism (10), a control circuit power source (2) electrically connected to functional switch (11), and the following control circuits:

CPU (1);

motor driving circuit (8), one end of this circuit is connected with CPU via electrical connection and the other end is connected with shredding mechanism (10) via electrical connection, is used to drive the shredding mechanism (10) to run;

reverse detection circuit (9), one end of which is electrically connected with CPU (1) and the other end is connected with shredding mechanism (10) via electrical connection, is used to detect the reverse signal and transfer such reverse signals to CPU (1), so that the CPU (1) will control the shredding mechanism (10) to reverse;

paper detection circuit (5), one end of which is electrically connected with CPU (1) and the other end is connected with a control circuit power source (2), is used to detect the paper-in signal; when the paper is put into the inlet of shredding mechanism (10), the paper-in detection circuit (5) will transfer the paper-in signal to CPU (1) for processing and then motor-driving circuit (8) is conducted and drives shredding mechanism (10) to run; if there is neither an input of paper-in signal nor the reverse signal after the paper is shredded, the said paper-in detection circuit (5) will transfer a self-lock signal to said CPU (1) and the CPU will begin timing; if the duration of said self-lock signal exceeds the preset value, CPU (1) will shut off the motor-driving circuit and paper shredder will be self-locked;

unlocking circuit (4), one end of which is electrically connected with CPU (1) and the other end is connected with a control circuit power source (2), is equipped with unlocking key (K1); when the paper shredder is in self-locking, unlocking circuit (4) will transfer the unlocking signal to CPU (1) if unlocking key (K1) is reset, so that CPU (1) will take control to close motor-driving circuit (8) and then the paper shredder will be unlocked.

2. A two-way self-lock paper shredder according to claim 1, wherein the unlocking circuit (4) is composed of resistance R11 and R12 and unlocking key (K1); one end of the resistance R11 is connected to the positive pole of control circuit power source (2) and the other end of resistance R11 is connected to one end of the unlocking key (K1), while, the other end of the unlocking key (K1) is electrically connected to CPU (1) and the resistance R12 respectively, and the other end of the resistance R12 is grounded.

3. A two-way self-lock paper shredder according to claim 2; further comprising an overload protection circuit (6), one end of which is connected with the shredding mechanism (10) and the other end of which is connected with CPU (1); the overload protection circuit (6) will transfer the overload signal to CPU (1) if an excessive amount of paper is put in, so that CPU (1) will take control to shut off the motor driving circuit (8).

4. A two-way self-lock paper shredder according to claim 3, further comprising a lock indication circuit (3), one end of which is electrically connected to CPU (1), and the other end of which is grounded; the lock indication circuit (3) is equipped with lock indicator, which is used to indicate whether the paper shredder is in self-locking status or not.

5. A two-way self-lock paper shredder according to claim 4, further comprising a lock status switching circuit (7), one end of which is connected to CPU (1) and the other end is connected to the positive pole of the control circuit power source (2) when the paper shredder possesses self-lock function or is grounded when paper shredder does not possess self-lock function.

6. A two-way self-lock paper shredder according to claim 5, wherein the lock status switching circuit (7) consists of resistance R13 and R14 and self-locking status key (K2); one end of the self-locking status key (K2) is electrically connected to CPU (1), the other end of the self-locking status key (K2) is electrically connected with R13 or R14, the other end of the resistance R13 is grounded, and the other end of the resistance R14 is connected to the positive pole of the control circuit power source (2).

7. A two-way self-lock paper shredder according to claim 1, further comprising an overload protection circuit (6), one end of which is connected with the shredding mechanism (10) and the other end of which is connected with CPU (1); the overload protection circuit (6) will transfer the overload signal to CPU (1) if an excessive amount of paper is put in, so that CPU (1) will take control to shut off the motor driving circuit (8).

* * * * *